US005584894A

United States Patent [19]

Peter-Hoblyn et al.

[11] Patent Number: 5,584,894

[45] Date of Patent: Dec. 17, 1996

[54] REDUCTION OF NITROGEN OXIDES EMISSIONS FROM VEHICULAR DIESEL ENGINES

[75] Inventors: Jeremy D. Peter-Hoblyn, Bodwin, Great Britain; James M. Valentine, Fairfield, Conn.

[73] Assignee: Platinum Plus, Inc., Stamford, Conn.

[21] Appl. No.: 251,520

[22] Filed: May 31, 1994

Related U.S. Application Data

[63] Continuation-in-part of Ser. No. 918,679, Jul. 22, 1992, abandoned, and Ser. No. 215,504, Mar. 21, 1994, abandoned.

[51] Int. Cl.[6] ..... C10L 1/32

[52] U.S. Cl. ..... 44/301; 44/354; 44/357

[58] Field of Search ..... 44/301, 354, 357

[56] References Cited

U.S. PATENT DOCUMENTS

| | | | |
|---|---|---|---|
| 2,086,775 | 7/1937 | Lyons et al. | 44/9 |
| 2,151,432 | 3/1939 | Lyons et al. | 44/9 |
| 3,348,932 | 10/1967 | Kukin | 44/357 |
| 3,658,302 | 4/1972 | Duthion et al. | 44/301 |
| 4,244,702 | 1/1981 | Alliger | 44/301 |
| 4,629,472 | 12/1986 | Haney, III et al. | 44/51 |
| 4,696,638 | 9/1987 | DenHerder | 431/4 |
| 4,824,439 | 4/1989 | Polanco et al. | 44/301 |
| 4,892,562 | 1/1990 | Bowers et al. | 44/67 |
| 5,000,757 | 3/1991 | Puttock et al. | 44/301 |
| 5,284,492 | 2/1994 | Dubin | 44/301 |

FOREIGN PATENT DOCUMENTS

| | | |
|---|---|---|
| 0475620A2 | 8/1991 | European Pat. Off. . |
| WO8603492 | 6/1986 | WIPO . |
| WO9007561 | 7/1990 | WIPO . |
| WO9307238 | 4/1993 | WIPO . |

OTHER PUBLICATIONS

"Diesel Particulate Filter System With Additive Supported Regeneration", Automobiltechnische Zeitschift, 91, 1989 (Month Unavailable).

*Primary Examiner*—Jacqueline V. Howard

*Attorney, Agent, or Firm*—St. Onge Steward Johnston & Reens

[57] ABSTRACT

The present invention relates to a process for reducing nitrogen oxides emissions from a diesel engine, which comprises preparing an emulsion of water in diesel fuel which contains a catalytically effective amount of catalyst composition and a lubricity additive, and supplying said emulsion to a diesel engine for combusting therein, whereby combustion of the emulsion leads to a reduction in the nitrogen oxides emissions from the diesel engine when compared with combustion of diesel fuel alone.

19 Claims, 1 Drawing Sheet

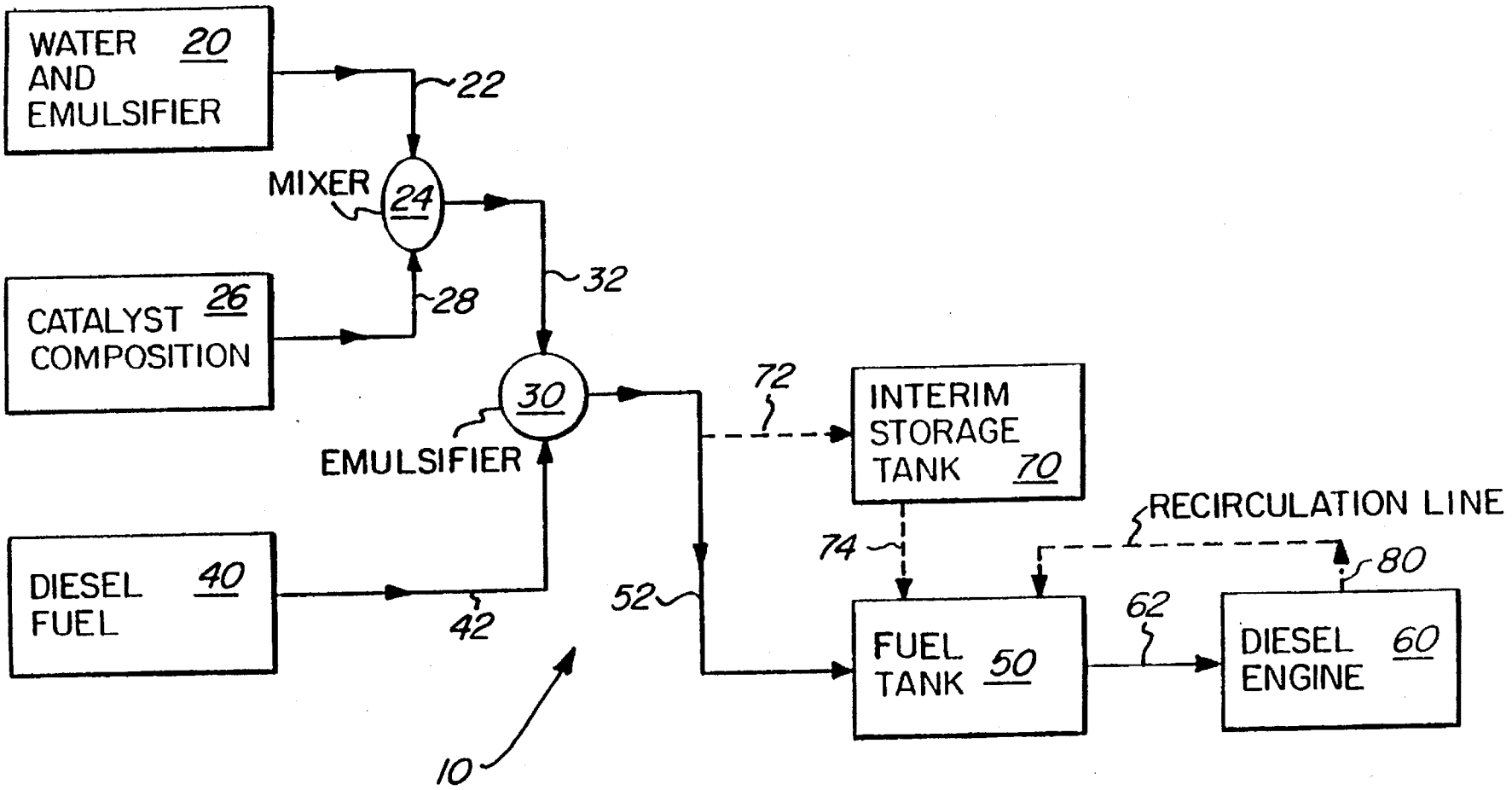
WATER AND EMULSIFIER 20
CATALYST COMPOSITION 26
DIESEL FUEL 40
MIXER 24
EMULSIFIER 30
INTERIM STORAGE TANK 70
FUEL TANK 50
DIESEL ENGINE 60
RECIRCULATION LINE
22
28
32
42
52
62
72
74
80
10

REDUCTION OF NITROGEN OXIDES EMISSIONS FROM VEHICULAR DIESEL ENGINES

RELATED APPLICATION

This application is a continuation-in-part of U.S. Patent Application entitled "The Reduction of Nitrogen Oxides Emissions from Vehicular Diesel Engines" Ser. No. 07/918,679, filed in the name of Valentine on Jul. 22, 1992 now abandoned and U.S. Patent Application entitled "Enhanced Lubricity Diesel Fuel Emulsions for Reduction of Nitrogen Oxide", Ser. No. 08/215,504 filed in the names of Peter-Hoblyn, Valentine and Dubin on Mar. 21, 1994, now abandoned, the disclosures of each of which are incorporated herein by reference.

TECHNICAL FIELD

The present invention relates to a process useful for reducing the nitrogen oxides ($NO_x$, where x is an integer, generally 1 or 2) emissions from a vehicular diesel engine to achieve reductions in nitrogen oxides in an efficient, economical, and safe manner not before seen.

One significant drawback to the use of diesel-fueled vehicles, including trucks, buses, passenger vehicles, locomotives, off-road vehicles, etc. (as opposed to gasoline-powered vehicles) results from their relatively high flame temperatures during combustion, which can be as high as 2200° F. and higher. Under such conditions there is a tendency for the production of thermal $NO_x$ in the engine, the temperatures being so high that free radicals of oxygen and nitrogen are formed and chemically combine as nitrogen oxides. In fact, $NO_x$ can also be formed as a result of the oxidation of nitrogenated species in the fuel.

Nitrogen oxides comprise a major irritant in smog and are believed to contribute to tropospheric ozone which is a known threat to health. In addition, nitrogen oxides can undergo photochemical smog formation through a series of reactions in the presence of sunlight and hydrocarbons. Furthermore, they have been implicated as a significant contributor to acid rain and are believed to augment the undesirable warming of the atmosphere which is generally referred to as the "greenhouse effect."

Methods for the reduction of $NO_x$ emissions from diesel engines which have previously been suggested include the use of catalytic converters, engine timing changes, exhaust gas recirculation, the combustion of "clean" fuels, such as methanol and natural gas, and the use of emulsions of water and fuel. Unfortunately, the first three would be difficult to implement because of the effort required to retrofit existing engines. In addition, they may cause increases in unburned hydrocarbons and particulate emissions to the atmosphere. Although the use of clean fuels does not have such drawbacks, such fuels require major changes in a vehicle's fuel system, as well as major commercial infrastructure changes for the production, distribution, and storage of such fuels.

It has been found that combusting a water and diesel fuel emulsion in a diesel engine as a way to reduce nitrogen oxide emissions can lead to mechanical problems. These problems are usually caused by the fact that the components of the engine are designed to operate within the lubricity characteristics of diesel fuel. Since a water and diesel fuel emulsion has lubricity far less than that of diesel fuel, a great deal of damage to the diesel engine components can be caused by combusting a water and fuel oil emulsion in the engine. Although this problem is apparent in virtually all diesel engines, it is especially significant for engines having aluminum parts which are more sensitive to damage in this way than steel, especially stainless steel, parts.

What is desired, therefore, is a method and composition which can achieve significant reductions in the $NO_x$ emissions from diesel engines without requiring substantial retrofitting of the engines, nor an increase in emission of other pollutants. The method and composition selected should be capable of being instituted on a commercial level without significant infrastructure changes.

BACKGROUND ART

The desirability of improving the efficiency of combustion in vehicle engines has long been recognized. For instance, Lyons and McKone in U.S. Pat. No. 2,086,775, and again in U.S. Pat. No. 2,151,432, disclose a method for improving combustion efficiency in an internal combustion engine by adding to the fuel what is described as "relatively minute quantities" of catalytic organometallic compounds. The Lyons and McKone patents, though, are directed solely to internal combustion engines and do not address the problem of $NO_x$ emissions from diesel engines.

In a unique application of catalytic technology described in International Publication No. WO 86/03492 and U.S. Pat. No. 4,892,562, Bowers and Sprague teach the preparation of diesel fuels containing fuel soluble platinum group metal compounds at levels of from 0.01 to 1.0 parts per million. The Bowers and Sprague results were corroborated and refined by the work of Kelso, Epperly, and Hart, described in "Effects of Platinum Fuel Additive on the Emissions and Efficiency of Diesel Engines," Society of Automotive Engineers (SAE) Paper No. 901 492, August 1990. Although the use of platinum group metal additives is effective, further nitrogen oxides reductions are still believed possible.

Moreover, in "Assessment of Diesel Particulate Control—Direct and Catalytic Oxidation," SAE Paper No. 81 0112, 1981, Murphy, Hillenbrand, Trayser, and Wasser have reported that the addition of catalyst metal to diesel fuel can improve the operation of a diesel trap. Among the catalysts disclosed is a platinum compound, albeit one containing chlorine, which is known to reduce catalyst effectiveness. In addition, the regeneration of a diesel trap by the use of a metallic additive which can include copper, nickel, cobalt, and, especially, iron, is discussed by Müller, Wiedemann, Preuss and Schäidlich in "Diesel Particulate Filter System with Additive Supported Regeneration," ATZ Automobiltechnische Zeitschift 91 (1989).

Other researchers have considered the use of water-in-oil emulsions for improving combustion efficiency in diesel engines. For instance, DenHerder, in U.S. Pat. No. 4,696,638, discusses such emulsions and indicates that the positive effects therefrom include "cleaner exhaust." Although the disclosure of DenHerder refers to emulsions containing up to about 40% water, DenHerder is primarily directed to emulsions having only up to about 10% water in the form of droplets having a diameter of about 1 to about 10 microns.

Furthermore, in "Diesel Engine $NO_x$ Control: Selective Catalytic Reduction and Methanol Emission," EPRI/EPA Joint Symposium on Stationary $NO_x$ Control, New Orleans, La., March, 1987, Wasset and Perry have reported that $NO_x$ reductions of up to 80%, which are the levels desired for effective emission control, can be achieved in diesel engines using water and oil emulsions. They found, though, that emulsions of at least 60% water-in-oil are necessary to achieve such reductions. Unfortunately, such high water ratios can lead to increased emissions of carbon monoxide (CO) and unburned hydrocarbons. In addition, such high water levels can also create problems in emulsion stability and create corrosion and storage volume concerns.

Accordingly, a process and composition which is effective at substantially reducing the nitrogen oxides emissions from a vehicular diesel engine without the drawbacks of the prior art is extremely desirable.

DISCLOSURE OF INVENTION

The present invention relates to a process for reducing $NO_x$ emissions from diesel engines, and involves the formation of an emulsion of water in diesel fuel at a water to fuel ratio of up to about 70% by weight, wherein the emulsion contains a catalytically effective amount of a platinum group metal composition and a lubricity additive selected from the group consisting of dimer acids, trimer acids, phosphate esters, sulfurized castor oil, and mixtures thereof. The invention then involves the combustion of the emulsion in a diesel engine.

BRIEF DESCRIPTION OF THE DRAWINGS

The present invention will be understood and its advantages more apparent in view of the following detailed description, especially when read with reference to the appended drawing which comprises a schematic illustration of a diesel engine fuel system according to the present invention.

DETAILED DESCRIPTION OF THE PREFERRED EMBODIMENT

As noted, this invention relates to a process which involves forming an emulsion of water in diesel fuel, which further contains a catalytic composition, especially a platinum group metal composition and a lubricity additive. The emulsion is used to fuel a diesel engine in order to reduce nitrogen oxides emissions from the engine. In more advantageous embodiments of the present invention, the catalytic composition comprises a water soluble platinum group metal composition.

The oil phase in the inventive emulsion comprises what is conventionally known as diesel fuel, as defined by the American Society of Testing and Management (ASTM) Standard Specification for Fuel Oils (designation: D 396-86). For the purposes of this description, diesel fuels are defined as fuel oil number 2 petroleum distillates of volatility and cetane number characteristics effective for the purpose of fueling internal combustion diesel engines.

The water which is used to form the emulsion is preferably demineralized water. Although demineralized water is not required for the successful control of nitrogen oxides, it is preferred in order to avoid the deposit of minerals from the water on the internal surfaces of the diesel engine fuel system through which the inventive emulsion flows. In this way, engine life is extended and maintenance and repair time significantly reduced.

The emulsion preferably comprises about 0.5% to about 70% water-in-diesel fuel. More preferably, the emulsion comprises about 5% to about 60%, and most preferably about 15% to about 45%, water in diesel fuel. The emulsion can be prepared by passing water and the diesel fuel through a mechanical emulsifying device which can be provided on site or within the fuel system of the diesel vehicle. After being emulsified, the subject emulsion can be stored in an appropriate storage unit or tank prior to combustion or supplied directly to a diesel engine as output from the emulsifier.

In an advantageous aspect of the invention, the emulsion is formed at a fueling station, especially at the fuel pump, where water and fuel are emulsified and then immediately pumped into the vehicle. In this way, emulsion storage and stability concerns are greatly reduced.

The emulsion of the present invention comprises a combustion catalyst such as compositions or complexes of cerium, a platinum group metal, copper, iron, or manganese. Such catalysts, especially when the composition comprises platinum or a platinum group metal, can be included in the emulsion at catalyst metal levels which can range from about 0.005 to about 1.0 pads per million (ppm), especially about 0.01 to about 0.5 ppm. Platinum group metals include platinum, palladium, rhodium, ruthenium, osmium, and iridium.

The combustion catalyst preferably comprises a water- or fuel-soluble platinum group metal composition. The composition should be temperature stable and preferably does not contain a substantial amount of phosphorus, arsenic, antimony or halides. If fuel solubility is desired, the composition should be non-ionic and organic in nature. The nonionic, organic nature of the composition provides solubility in the fuel, thereby facilitating the introduction of the composition into the combustion chamber.

Temperature stability of the catalyst composition is important in practical and operational terms. In a commercial setting, a combustion catalyst can often sit in storage for extended periods of time during which it can be exposed to great variations in temperature. If the breakdown temperature of the composition is not sufficiently high (i.e., if the composition is not temperature stable at the temperatures to which it is expected to be exposed), then it may break down and be less effective. Moreover, breakdown of the composition after mixing with the water or fuel may render the catalyst composition insoluble since the solubility is provided by the functional groups. Such loss of solubility can cause the combustion catalyst to precipitate and not reach the combustion chamber, as discussed above. Typically, the breakdown temperature of the compositions should be at least about 40° C., and preferably at least about 50° C., in order to protect against most temperatures to which it can be expected to be exposed. In some circumstances, it will be necessary that the breakdown temperature be no lower than about 75° C.

As noted, the composition of the present invention preferably does not contain a substantial amount of objectionable functional groups such as phosphorus, arsenic, antimony and, especially, halides, which can, under some circumstances, have significant disadvantages like "poisoning" or otherwise reducing the effectiveness of the platinum group metal composition catalyst. Halides can have the additional undesirable effect of rendering a platinum group metal more volatile, leading to reduction of the amount of platinum group metal in the combustion chamber and engine system. A substantial amount of such functional groups is considered an amount effective to significantly reduce the effectiveness of the catalyst. Preferably, the purified platinum group metal composition contains no more than about 500 ppm (on a weight per weight basis) of phosphorus, arsenic, antimony or halides, more preferably no more than about 250 ppm. Most preferably, the composition contains no phosphorus, arsenic, antimony or halides. Such objectionable functional groups can be minimized in several ways. The platinum group metal composition can be prepared in a process which utilizes precursors or reactant compositions having a minimum of such functional groups; or the platinum group metal composition can be purified after preparation. Most such methods of purifications are known to the skilled artisan.

One preferred method of purifying the platinum group metal composition to remove halides is a process utilizing silver salts having non-halide anions which are harmless as compared to the halides being replaced and involves reacting them with the platinum group metal compound, whereby the halides in the composition are replaced by the anion of the silver salt (which can be any silver salts of carboxylic acids, such as silver benzoate, or silver nitrate) and the resulting composition is free of halides, plus a silver halide is produced. For instance, a slurry or solution of silver nitrate or silver benzoate in a polar solvent such as acetone or an alcohol and water mixture can be prepared and reacted with the platinum group metal composition. The resultant platinum group metal composition is a benzoate or nitrate salt with silver halide also being produced. This process can be expected to reduce the halide content of a sample by about 50%, and even up to about 90% and higher.

Few, if any, platinum group metal compounds which are directly soluble in water or diesel fuel are available commercially. Compounds which are available often contain objectionable functional groups containing halogen and phosphorus and, therefore, are less than preferred for many internal combustion applications. Preferably, the compounds according to the present invention will have no phosphorus or have such low levels that they are free of significant disadvantages.

Suitable catalysts which are water soluble or water dispersible (and, therefore, preferred) are disclosed by Haney and Sullivan in U.S. Pat. No. 4,629,472, the disclosure of which is incorporated herein by reference. These catalytic compositions include:

ruthenium (IV) oxide
potassium ruthenium (VI) oxide
rhodium (III) oxide
rhodium (III) nitrate, and its hydrates
iridium (III) oxide
iridium (IV) oxide
osmium tetroxide
platinum black
platinum (IV) oxide, and its hydrates
hydrogen hexahydroxoplatinum (IV)
dinitritodiammineplatinum (II)
dihydrogen sulphatodinitrito platinum (II)
tetraammineplatinum (II) dinitrate
palladium (II) oxide
palladium (II) nitratedihydrate
tetraamminepalladium (II) nitrate
potassium tetracyanopalladium (II) trihydrate
potassium perrhenate
tris(acetyl acetonate)rhenium (III)
2-hydroxyethanethiolato(2,2',2"-terpyridine)platinum (II) nitrate, $[Pt(C_2H_5OS)(C_{15}H_{11}N_3)]NO_3$
Rhodium (II) octanoate dimer, $Rh_2[O_2C(CH_2)_6CH_3]_4$
acetylacetonato(1,5-cyclooctadiene), rhodium (I), $Rh(C_8H_{12})(C_5H_7O_2)$
acetylacetonato(norbornadiene), rhodium (I), $Rh(C_7H_8)(C_5H_7O_2)$
Bis(dibenzylideneacetone), palladium (O) $Pd(C_{17}H_{14}O)_2$
Tris(2,2'-bipyridine)ruthenium (O) $(C_{10}H_8N_2)_3Ru$
Bis(cyclopentadienyl)ruthenium (II) "Ruthenocene" $(C_5H_5)_2RU$
Bis(acetylacetonato)platinum (II) $[Pt(C_5H_7O_2)_2]$
Bis(acetylacetonato)palladium (II) $[Pd(C_5H_7O_2)_2]$
Palladium (II) acetate trimer $[Pd(CH_3CO_2)_2]_3$
Tris(acetylacetonato)ruthenium (III) $[Ru(C_5H_7O_2)]$
Tris(acetylacetonato)rhodium (III) $[Rh(C_5H^7O_2)_3]$
Rhodium (II) acetate dimer $[RH_2(CO_2CH_3)_4]$
Tris(acetylacetonato)iridium (III) $[Ir(C_5H_7O_2)_3]$
Dodecacarbonyltriosmium (O) $Os_3(CO)_{12}$ In the alternative, a catalyst can be included within the fuel phase of the system, or added to the emulsion after it is formed. In this case, the catalyst composition can be fuel soluble, such as those disclosed by Bowers and Sprague in U.S. Pat. No. 4,892,562 and Epperly, Sprague, Kelso, and Bowers in International Publication No. WO 90/07561, the disclosures of each of which are incorporated herein by reference. Of course, where the catalyst is added to the fuel phase prior to emulsification, the partition ratio, that is, the ratio of solubility in the fuel as compared with the aqueous phase, of the catalyst composition should preferably be as described in International Publication No. W0 90/07561.

The preferred class of materials used as fuel soluble catalyst compositions include platinum group metal oxidation states II and IV. Compounds in the lower (II) state of oxidation are preferred due to their function in generating the catalytic effect. A significant feature of the invention is the use of platinum group metal II coordination compounds having at least one coordination site occupied by a functional group containing an unsaturated carbon-to-carbon bond. Preferably, two or more of the coordination sites will be occupied by such functional groups since the stability and solubility in diesel fuel of compounds having such multiple functional groups are improved. While not wishing to be bound to any particular theory, it is believed that such preferred compounds in the lowest possible oxidation state are the most beneficial for producing the desired catalytic effect.

Occupation of one or more coordination sites with the following unsaturated functional groups has been found useful:

1. Benzene and analogous aromatic compounds such as anthracene and naphthalene.
2. Cyclic dienes and homologues such as cylooctadiene, methyl cyclopentadiene, and cyclohexadiene.
3. Olefins such as nonene, dodecene, and polyisobutenes.
4. Acetylenes such as nonyne and dodecyne.

These unsaturated functional groups, in turn, can be substituted with nonhalogen-substituents such as alkyl, carboxyl, amino, nitro, hydroxyl, and alkoxyl groups. Other coordination sites can be directly occupied by such groups.

The general formula for the preferred coordination II compounds is:

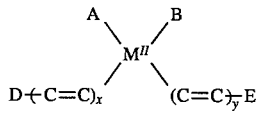

where $M^{II}$ represents the platinum group metal, with a valence of +2, where A, B, D, and E are groups such as alkoxy, carboxyl, etc. described above, where $(C{=}C)_x$ and $(C{=}C)_y$ represent unsaturated functional groups coordinated with the platinum group metal, and where x and y are any integer, typically 1 to 5.

The most preferred platinum group coordination compounds are those represented by the following formula:

$$XM^{II}R_2$$

wherein X is a cyclooctadienyl ligand, M is a platinum group metal, and R is benzyl, phenyl or nitrobenzyl.

Among other suitable platinum group metal compounds, especially palladium compounds, are the following which include at least one sigma or pi carbon to platinum group metal bond, including (a) 2,2'-bis(N,N-dialkylamino)1,1'-diphenyl metals, such as represented by the formula

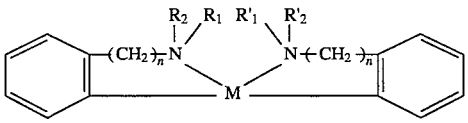

wherein M is a platinum group metal; $R_1$ and $R_2$ are lower alkyl, e.g., from 1 to 10 carbons; and each n is, independently, an integer from 1 to 5. Representative of this group is 2,2'-bis(N,N-dimethylamino)1,1'-diphenyl palladium;

(b) tetrakis (alkoxy carbonyl) metal cycloalkenes, as represented by the formula $$M(C_4COOR_1)_4R_2$$

wherein M is a platinum group metal; $R_1$ is a lower alkyl, e.g., from 1 to 5 carbons, and $R_2$ is a cycloalkene having, e.g., from 5 to 8 carbons and from 2 to 4 unsaturations within the ring structure. Representative of this group is tetrakis (methoxy carbonyl) palladia cyclopentadiene;

(c) μ-diphenyl acetylene bis($\eta^5$pentaphenyl cyclopentadiene) di metals as represented by the formula $$(\Phi C\ C\Phi)(C_5M)_2$$

wherein M is a platinum group metal and is phenyl. Representative of this group is μ-diphenyl acetylene bis ($\eta^5$-pentaphenyl cyclopentadiene)dipalladium;

(d) dialkyl dipyridyl metals of the formula

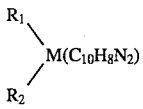

wherein M is a platinum group metal; and $R_1$ and $R_2$ are lower alkyl, e.g., having from 1 to 5 carbons. Representative of this group is diethyl dipyridyl palladium; and (e) bis(π-allyl) metals of the formula $$(R\text{-}C_3H_5)_2M$$

wherein M is a platinum group metal and R is hydrogen, aryl, or alkyl, e.g., one to ten carbons. Representative of this group is bis (phenyl allyl) palladium. Other specific suitable fuel soluble compounds according to the present invention include those platinum metal group-containing compositions selected from the group consisting of f) a composition of the general formula $$L^1PtR^1R^2$$

wherein $L^1$ is either a single cyclic polyolefin or nitrogenous bidentate ligand or a pair of nitrogenous or acetylenic monodentate ligands; and $R^1$ and $R^2$ are each, independently, substituted or unsubstituted methyl, benzyl, aryl, cyclopentadiene or pentamethyl cyclopentadiene, preferably benzyl, methyl and/or phenyl;

g) a composition of the general formula $$L^2M^1R^3$$

wherein $L^2$ is either a single cyclic polyolefin or nitrogenous bidentate ligand or a pair of nitrogenous or acetylenic monodentate ligands; $M^1$ is rhodium or iridium; and $R^3$ is cyclopentadiene or pentamethyl cyclopentadiene;

h) a composition of the general formula $$L^3M^2(C_4R^4{}_4)$$

wherein $L^3$ is either a single cyclic polyolefin or nitrogenous bidentate ligand or a pair of nitrogenous monodentate ligands; $M^2$ is platinum, palladium, rhodium or iridium; and $R^4$ is $COOR^5$, wherein $R^5$ is hydrogen or alkyl having from 1 to 10 carbons, preferably methyl;

i) a composition of the general formula $$L^4M^3(COOR^6)_2$$

or a dimer thereof, wherein $L^4$ is a non-nitrogenous cyclic polyolefin ligand, preferably cyclooctadiene or pentamethyl cyclopentadiene; $M^3$ is platinum or iridium; and $R^6$ is benzyl, aryl or alkyl, preferably having 4 or more carbons, most preferably phenyl; and j) a composition comprising the reaction product of $[L^5RhX]_2$ and $R^7MgX$ wherein $L^5$ is a non-nitrogenous cyclic polyolefin ligand, preferably cyclooctadiene or pentamethyl cyclopentadiene; $R^7$ is methyl, benzyl, aryl, cyclopentadiene or pentamethyl cyclopentadiene, preferably benzyl or phenyl; and X is a halide. Although presently uncharacterized, it is believed that this reaction product assumes the formula $L^5RhR^7$.

Functional groups which are especially preferred for use as ligands $L^1$ through $L^4$ are neutral bidentate ligands such as cyclopentadiene, cyclooctadiene, pentamethyl cyclopentadiene, cyclooctadiene, pentamethyl cyclopentadiene, cyclooctatetrene, norbornadiene, o-toluidine, o-phenantholine and bipyridine. Most preferred among monodentate ligands is pyridine.

Advantageously, the emulsions are prepared such that the discontinuous phase (i.e., the water) has a particle size wherein at least about 70% of the droplets are below about 5 microns Sauter mean diameter. More preferably, at least about 85%, and most preferably at least about 90%, are below about 5 microns Sauter mean diameter.

Emulsion stability is largely related to droplet size. The primary driving force for emulsion separation is the large energy associated with placing oil molecules in close proximity to water molecules in the form of small droplets. Emulsion breakdown is controlled by how quickly droplets coalesce. Emulsion stability can be enhanced by the use of surfactants and the like, which act as emulsifiers or emulsion stabilizers. These generally work by forming repulsive layers between droplets prohibiting coalescence. The gravitational driving force for phase separation is much more prominent for large droplets, so emulsions containing large droplets separate most rapidly.

Smaller droplets also settle, but can be less prone to coalescence, which is the cause of creaming. If droplets are sufficiently small, the force of gravity acting on the droplet is small compared to thermal fluctuations or subtle mechanical agitation forces. In this case the emulsion can become stable almost indefinitely, although given a long enough period of time or a combination of thermal fluctuations these emulsions will eventually separate.

Because the inventive emulsion may have to sit stagnant in storage, for instance, when used as a fuel source for highway vehicles where it is pumped into a holding tank from which limited amounts are pumped out for the vehicles, it may be necessary to include a component effective for maintaining the stability of the emulsion such as a surfactant. In fact, sufficient stabilizing component may be needed to provide stability for up to about six months in the case of use for highway vehicles. Even where shorter fuel residence times are encountered, such as by captive fueled city buses or delivery vehicles, emulsion stability for one week or greater may still be necessary.

In order to avoid separation of the emulsion into its components, which can cause slugs of water to be injected through the injector nozzle leading to combustion problems and possible engine damage, an emulsifier or emulsion stabilizer should also be included in the emulsion. Suitable emulsifiers or emulsion stabilizers are known to the skilled artisan and include alkanolamides and phenolic surfactants such as ethoxylated alkylphenols, as well as various other phenolic and other art-known surfactants. Advantageously, the emulsifier is present in the emulsion at a level of about 0.01% to about 3.0% by weight. When used, the emulsifier is preferably provided in the aqueous phase.

In a European Patent Application having Publication No. 0 475 620 A2, Smith, Bock, Robbins, Pace, and Grimes disclose an emulsifier blend which they describe as effective at emulsifying a water-in-diesel fuel emulsion. The disclosed blend comprises a hydrophilic surfactant such as alkyl carboxylic and alkylaryl sulfonic acid salts and ethoxylated alkyl phenols, and a lipophilic surfactant such as ethoxylated alkyl phenols and alkyl and alkylaryl sulfonic acid salts. The emulsifier blends can also include cosurfactants and polar organic solvents. The disclosure of the Smith et al. European application is incorporated herein by reference.

The use of the noted emulsifiers provides chemical emulsification, which is dependent on hydrophyliclipophylic balance (HLB), as well as on the chemical nature of the emulsifier. The HLB of an emulsifier is an expression of the balance of the size and strength of the hydrophylic and the lipophylic groups of the composition. The HLB, which was developed as a guide to emulsifiers by ICI Americas, Inc. of Wilmington, Del. can be determined in a number of ways, most conveniently for the purposes of this invention by the solubility or dispersibility characteristics of the emulsifier in water, from no dispersibility (HLB range of 1–4) to clear solution (HLB range of 13 or greater). The emulsifiers useful in the present invention should most preferably have an HLB of 8 or less, meaning that after vigorous agitation they form a milky dispersion in water (HLB range of 6–8), poor dispersion in water (HLB range of 4–6), or show no dispersability in water (HLB range of less than 4).

Another desirable emulsification system which can be utilized is taught by Dubin and Wegrzyn in the International Application entitled "Emulsification System For Light Fuel Oil Emulsions", having International Publication No. WO 93/07238, published Apr. 15, 1993. The disclosed emulsification system comprises about 25% to about 85% by weight of an amide, especially an alkanolamide or n-substituted alkyl amine; about 5% to about 25% by weight of a phenolic surfactant; and about 0% to about 40% by weight of a difunctional block polymer terminating in a primary hydroxyl group. More preferably, the amide comprises about 45% to about 65% of the emulsification system; the phenolic surfactant about 5% to about 15%; and the difunctional block polymer about 30% to about 40% of the emulsification system.

Suitable n-substituted alkyl amines and alkanolamides which can function to stabilize the emulsion of the present invention are those formed by the condensation of, respectively, an alkyl amine and an organic acid or a hydroxyalkyl amine and an organic acid, which is preferably of a length normally associated with fatty acids. They can be mono-, di-, or triethanolamines and include any one or more of the following: oleic diethanolamide, cocamide diethanolamine (DEA), lauramide DEA, polyoxyethylene (POE) cocamide, cocamide monoethanolamine (MEA), POE lauramide DEA, oleamide DEA, linoleamide DEA, stearamide MEA, and oleic triethanolamine, as well as mixtures thereof. Such alkanolamides are commercially available, including those under trade names such as Clindrol 100-0, from Clintwood Chemical Company of Chicago, Ill.; Schercomid ODA, from Scher Chemicals, Inc. of Clifton, N.J.; Schercomid SO-A, also from Scher Chemicals, Inc.; Mazamide®, and the Mazamide series from PPG-Mazer Products Corp. of Gurnee, Ill.; the Mackamide series from Mcintyre Group, Inc. of University Park, Ill.; and the Witcamide series from Witco Chemical Co. of Houston, Tex.

The phenolic surfactant is preferably an ethoxylated alkyl phenol such as an ethoxylated nonylphenol or octylphenol. Especially preferred is ethylene oxide nonylphenol, which is available commercially under the tradename Triton N from Union Carbide Corporation of Danbury, Conn. and Igepal CO from Rhone-Poulenc Company of Wilmington, Del.

The block polymer which is an optional element of the emulsification system advantageously comprises a nonionic, difunctional block polymer which terminates in a primary hydroxyl group and has a molecular weight ranging from about 1,000 to above about 15,000. Such polymers are generally considered to be polyoxyalkylene derivatives of propylene glycol and are commercially available under the tradename Pluronic from BASF-Wyandotte Company of Wyandotte, N.J. Preferred among these polymers are propylene oxide/ethylene oxide block polymers commercially available as Pluronic 17R1.

Desirably, the emulsification system should be present at a level which will ensure effective emulsification. Preferably, the emulsification system is present at a level of at least about 0.05% by weight of the emulsion to do so. Although there is no true upper limit to the amount of the emulsification system which is present, with higher levels leading to greater emulsification and for longer periods, there is generally no need for more than about 5.0% by weight, nor, in fact, more than about 3.0% by weight.

It is also possible to utilize a physical emulsion stabilizer in combination with the emulsification system noted above to maximize the stability of the emulsion. Use of physical stabilizers also provides economic benefits due to their relatively low cost. Although not wishing to be bound by any theory, it is believed that physical stabilizers increase emulsion stability by increasing the viscosity of immiscible phases such that separation of the oil/water interface is retarded. Exemplary of suitable physical stabilizers are waxes, cellulose products, and gums such as whalen gum and xanthan gum.

When utilizing both the emulsification system and physical emulsion stabilizers, the physical stabilizer is present in an amount of about 0.05% to about 5% by weight of the combination of chemical emulsifier and the physical stabilizer. The resulting combination emulsifier/stabilizer can then be used at the same levels noted above for the use of the emulsification system.

The emulsion used in the present invention can be formed using a suitable mechanical emulsifying apparatus which would be familiar to the skilled artisan. Advantageously, the apparatus is an in-line emulsifying device for most efficiency. The emulsion is formed by feeding both the water and the diesel fuel in the desired proportions to the emulsifying apparatus, and the emulsification system can either be admixed or dispersed into one or both of the components before emulsification or can be added to the emulsion after it is formed.

It has now surprisingly been found that the addition of a component selected from the group consisting of dimer and/or trimer acids, sulfurized castor oil, phosphate esters, and other like materials which will enhance the lubricity of the emulsion, and mixtures thereof will significantly increase the lubricity of the subject water and diesel fuel emulsions and avoid the mechanical problems associated with such emulsions when combusted in a diesel engine. Most preferred among these are the dimer and/or trimer acids or blends thereof.

Dimer acids are high molecular weight dibasic acids produced by the dimerization of unsaturated fatty acids at mid-molecule and usually contain 21–36 carbons. Similarly, trimer acids contain three carboxyl groups and usually 54 carbons. Dimer and trimer acids are generally made by a Diels Alder reaction. This usually involves the reaction of an unsaturated fatty acid with another polyunsaturated fatty acid—typically linoleic acid. Starting raw materials usually include tall oil fatty acids. In addition, it is also known to form dimer and trimer acids by reacting acrylic acid with polyunsaturated fatty acids.

After the reaction, the product usually comprises a small amount of monomer units, dimer acid, trimer acid, and higher analogs. Where the product desired is primarily dimer acid (i.e., at least about 85% dimer acid), the reactant product is often merely referred to as dimer acid. However, the individual components can be separated to provide a more pure form of dimer acid or trimer acid by itself.

Suitable dimer acids for use in this invention include Westvaco Diacid 1550, commercially available from Westvaco Chemicals of Charleston Heights, S.C.; Unidyme 12 and Unidyme 14, commercially available from Union Camp Corporation of Dover, Ohio; Empol 1022, commercially available from Henkel Corporation of Cincinnati, Ohio; and Hystrene 3695, commercially available from Witco Co. of Memphis, Tenn.

In addition, blends of dimer and trimer acids can also be used as the lubricity additive of the present invention. These blends can be formed by combining dimer and trimer acids, or can comprise the reaction product from the formation of the dimer acid, which can contain substantial amounts of trimer acid. Generally, blends comprise about 5% to about 80% dimer acid. Specific blends include a blend of about 75% dimer acid and about 25% trimer acid, commercially available as Hystrene 3675, a blend of 40% dimer acid and 60% trimer acid, commercially available as Hystrene 5460, and a blend of about 60% dimer acid and about 40% trimer acid, all commercially available from Witco Co. of Memphis, Tenn.

Phosphate esters useful as the lubricity additive of the present invention can be prepared by phosphorylation of aliphatic and aromatic ethoxylates. These phosphate esters can be hydrophylic or lipophylic and include phosphate esters of fatty alcohol ethoxylates. Suitable phosphate esters are commercially available as Antara LB700, a hydrophylic phosphate ester and Antara LB400, a lipophylic phosphate ester, both of which are commercially available from Rhone-Poulenc Co. of Cranbury, N.J. The sulfurized castor oil which may be used in the present invention is commercially available as Actrasol C-75 from Climax Performance Materials Corporation Co. of Summit, Ill.

As noted above, the use of dimer or trimer acids is highly preferred as the lubricity additive of the present invention, as compared to phosphate esters or sulfurized castor oil. This is because the combustion of emulsions using the dimer and/or trimer acid lubricity additives produce less ash, with less than about 0.2% ash being highly preferred.

The lubricity agent provided in the noted emulsions should be present at a level which varies between about 50 and about 550 pads per million (ppm) in the emulsion. Most preferably, the lubricity additive is present at levels of about 100 to about 400 ppm. At these levels, emulsions of up to about 85% water-in-fuel oil or as low as about 15% fuel oil-in-water will exhibit lubricities comparable to those of diesel fuel alone.

Most advantageously, when an emulsification system is employed to maintain emulsion stability, the lubricity agent is incorporated into the emulsification system and applied to the emulsion in this manner. The lubricity agent should be present in the emulsification system, which when applied at a level of about 1500 to about 3500 ppm, more advantageously about 2500 to about 3000 ppm, ensures the desired level of lubricity agent is present in the final emulsion.

Interestingly, the lubricity gains provided by the inventive lubricity additive are relatively specific to diesel fuel and water emulsions. In tests on diesel fuel alone, and water alone, no significant increases in lubricity have been noted, yet incorporation of the noted lubricity additives in a diesel fuel and water emulsion creates significant increases in the lubricity of the emulsion. In fact, when added to diesel fuel and water emulsions, the lubricity additives increase the emulsion lubricity to levels equivalent to those for fuel oil alone.

Since most feed lines for a diesel engine are designed with the intent that they be exposed only to an essentially non-aqueous environment, it is also desirable to incorporate a corrosion inhibitor in the emulsion. Suitable corrosion preventing additives include filming amines, such as organic, ethoxylated amines. Among these are N,N',N'-tris(2-hydroxyethyl)-N-tallow-1,3-diaminopropane, commercially available as Ethoduomeen T/13 from Akzo Chemicals, Incorporated of Chicago, Ill.; an oleic diethanolamide which is the reaction product of methyl oleate and diethanolamine; an alkanolamide commercially available as Mackamide MO from Mcintyre Co. of Chicago, Ill.; and Ethoduomeen T/25, which is a higher ethoxylated version of Ethoduomeen T/13. Moreover, a biocidal agent can also be employed, to prevent biological contamination of the fuel and engine lines.

The appended drawing figure illustrates a diesel engine vehicle fuel system 10 which makes use of a preferred embodiment of the present invention. As illustrated therein, water is provided from a suitable source tank 20 through line 22 to an in-line mixer 24 via a suitable pump (not shown). When the aqueous phase comprises water (and emulsifier) and catalyst composition, the catalyst composition is supplied from tank 26 through line or conduit 28 by the action of a suitable pump (not shown) to in-line mixer 24. The water is then directed via a pump (not shown) through line 32 to a mechanical emulsifier 30. Diesel fuel from a suitable source tank 40 is concurrently directed by the action of a pump (not shown) to emulsifier 30 through line 42 where the diesel fuel and water are emulsified together in the appropriate ratios.

After exiting from emulsifier 30 the diesel fuel emulsion is directed via line 52 to emulsion tank 50 via a suitable pump (not shown) from where it is fed by a pump (not shown) via line 62 to diesel engine 60. In the alternative, the emulsion exiting from mechanical emulsifier 30 can be supplied via lines 52 and 72 to interim storage tank 70 where it is stored prior to combustion. The emulsion is then directed from storage tank 70 through line 74 to emulsion tank 50 and then to diesel engine 60.

In addition, in order to maintain emulsion stability, the emulsion from diesel engine 60 can be recirculated via recirculation line 80 to emulsion tank 50 and then back to diesel engine 60 via line 62. Thus, by use of the illustrated system, a diesel vehicle can be modified to prepare and combust an aqueous emulsion comprising a combustion catalyst in diesel fuel.

Although the precise reason for the degree of nitrogen oxides reductions achievable with the present invention is not fully understood, it is believed that the water component of the subject emulsion serves to reduce the peak flame temperature of combustion which limits overall $NO_x$ formation. The catalyst composition (when used) results in an increase in combustion efficiency (as well as an increase in horsepower and fuel economy, it is believed).

Accordingly, use of the inventive emulsion in the illustrated diesel engine fuel system leads to reduction of nitrogen oxides under conditions and to levels not before thought possible.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention, which is defined by the following claims.

We claim:

1. A process for reducing nitrogen oxides emissions from a vehicular diesel engine comprising forming an emulsion of water in diesel fuel which comprises up to about 70% water by weight, further comprising a catalytically effective amount of a catalyst composition and a lubricity additive, and supplying said emulsion to a vehicular diesel engine to be combusted therein, whereby combustion of the emulsion leads to a reduction in the nitrogen oxides emissions from the diesel engine when compared with combustion of diesel fuel alone.

2. The process of claim 1, wherein at least about 70% of the water droplets have a particle size below about 5 microns Sauter mean diameter.

3. The process of claim 1, wherein said catalyst composition comprises a composition or complex of a metal selected from the group consisting of cerium, platinum or a platinum group metal, copper, iron, or manganese.

4. The process of claim 3, wherein said catalyst composition is present in said emulsion at a level of about 0.005 to about 1.0 parts per million.

5. The process of claim 4, wherein said catalyst composition comprises a water soluble or water dispersible platinum group metal composition present in the aqueous phase of said emulsion.

6. The process of claim 5, wherein said catalyst composition is selected from the group consisting of ruthenium (IV) oxide; potassium ruthenium (VI) oxide; rhodium (III) oxide; rhodium (III) nitrate, and its hydrates; iridium (III) oxide; iridium (IV) oxide; osmium tetroxide; platinum black; platinum (IV) oxide, and its hydrates; hydrogen hexahydroxoplatinum (IV); dinitritodiammineplatinum (II); dihydrogen sulphatodinitrito platinum (II); tetraammineplatinum (II) dinitrate; palladium (II) oxide; palladium (II) nitratedihydrate; tetraamminepalladium (II) nitrate; potassium tetracyanopalladium (II) trihydrate; potassium perrhenate; tris (acetyl acetonate) rhenium (III); 2-hydroxyethanethiolato (2,2',2"-terpyridine)platinum (II) nitrate; Rhodium (II) octanoate dimer; acetylacetonato(1,5-cyclooctadiene), rhodium (I); acetylacetonato (norbomadiene), rhodium (I); Bis (dibenzylideneacetone), palladium (O); Tris(2,2'-bipyridine)ruthenium (O); Bis(cyclopentadienyl)-ruthenium (II); Bis (acetylacetonato)platinum (II); Bis(acetylacetonato)palladium (II); Palladium (II) acetate trimer; Tris(acetylacetonato)ruthenium (III); Tris(acetylacetonato)rhodium (III); Rhodium (II) acetate dimer; Tris(acetylacetonato)iridium (III); Dodecacarbonyltriosmium (O); and combinations thereof.

7. The process of claim 4, wherein said catalyst composition comprises a fuel soluble platinum group metal composition present in the fuel phase of said emulsion or in said emulsion after it is formed.

8. The process of claim 7, wherein said catalyst comprises a platinum group metal II coordination compound having at least one coordination site occupied by a functional group containing an unsaturated carbon-to-carbon bond.

9. The process of claim 8, wherein said catalyst composition comprises a composition having the general formula:

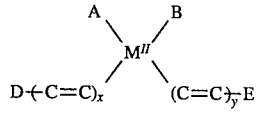

where $M^{II}$ is a platinum group metal with a valence of +2, A, B, D, and E are each, independently, selected from the group consisting of alkyl, carboxyl, amino, nitro, hydroxyl, and alkoxyl, $(C{=}C)_x$ and $(C{=}C)_y$ are unsaturated functional groups coordinated with the platinum group metal, and x and y are, independently, any integer, typically 1 to 5.

10. The process of claim 9, wherein said catalyst composition comprises a composition having the general formula:

$$X\,M^{II}R_2$$

wherein X is a cyclooctadienyl ligand, M is a platinum group metal, and R is benzyl, phenyl, or nitrobenzyl.

11. The process of claim 1, wherein said lubricity additive is present at a level of at least about 100 ppm.

12. The process of claim 11, wherein said lubricity additive comprises dimer acids, trimer acids, blends of dimer and trimer acids, phosphate esters, sulfurized castor oil, and mixtures thereof.

13. The process of claim 11, wherein said lubricity additive further comprises a corrosion inhibitor comprising a filming amine.

14. The process of claim 1, which further comprises an emulsification system comprising:

a) about 25% to about 85% of an amide;

b) about 5% to about 25% of a phenolic surfactant; and c) about 0% to about 40% of a difunctional block polymer terminating in a primary hydroxyl group.

15. The process of claim 14, wherein said amide comprises an alkanolamide formed by condensation of a hydroxy-alkyl amine with an organic acid.

16. The process of claim 14, wherein said phenolic surfactant comprises an ethoxylated alkylphenol.

17. The process of claim 16, wherein said ethoxylated alkylphenol comprises ethylene oxide nonylphenyl.

18. The process of claim 5, wherein said difunctional block polymer comprises propylene oxide/ethylene oxide block polymer.

19. The process of claim 5, wherein said emulsification system is present in an amount of about 0.05% to about 5.0% by weight.

* * * * *

UNITED STATES PATENT AND TRADEMARK OFFICE

CERTIFICATE OF CORRECTION

PATENT NO. : 5,584,894

DATED : December 17, 1996

INVENTOR(S) : **Peter-Hoblyn *et al.***

It is certified that error appears in the above-indentified patent and that said Letters Patent is hereby corrected as shown below:

Column 2, line 62, "Wasset" should be replaced with --Wasser--.

Column 10, line 13, "Mcintyre" should be replaced with --McIntyre--.

Column 12, line 3, "pads" should be replaced with --parts --.

Column 12, line 39, "Mcintyre" should be replaced with –McIntyre--.

Signed and Sealed this

First Day of April, 1997

Bruce Lehman

*Attest:*

BRUCE LEHMAN

*Attesting Officer*

*Commissioner of Patents and Trademarks*